United States Patent [19]

Van Uden

[11] Patent Number: 4,931,689

[45] Date of Patent: Jun. 5, 1990

[54] COLOR DISPLAY TUBE

[75] Inventor: Maria C. Van Uden, Eindhoven, Netherlands

[73] Assignee: U.S. Philips Corporation, New York, N.Y.

[21] Appl. No.: 164,040

[22] Filed: Mar. 4, 1988

Related U.S. Application Data

[63] Continuation of Ser. No. 879,830, Jun. 26, 1986, abandoned, which is a continuation of Ser. No. 636,535, Aug. 1, 1984, abandoned.

[30] Foreign Application Priority Data

Mar. 14, 1984 [NL] Netherlands ..... 8400806

[51] Int. Cl.[5] ..... H01J 29/80

[52] U.S. Cl. ..... 313/402; 313/403; 313/407; 313/408

[58] Field of Search ..... 313/402, 403, 407, 408, 313/410

[56] References Cited

FOREIGN PATENT DOCUMENTS 0139379 2/1985 Japan .

2080612 2/1982 Netherlands ..... 313/402

*Primary Examiner*—Leo H. Boudreau

*Assistant Examiner*—Michael Razavi

*Attorney, Agent, or Firm*—John C. Fox

[57] ABSTRACT

The invention relates to a color display tube comprising a shadow mask (12) placed in front of the display screen (8). The shadow mask (12), at least on the side remote from the display screen, is coated with a glass layer (14) comprising a heavy metal. The object of such a layer is to reflect electrons incident on it so as to reduce local or overall heating. By means of the glass layer it is achieved that it crumbles away less easily, which inter alia is in favor of the picture quality, and that the shadow mask is more rigid.

1 Claim, 1 Drawing Sheet

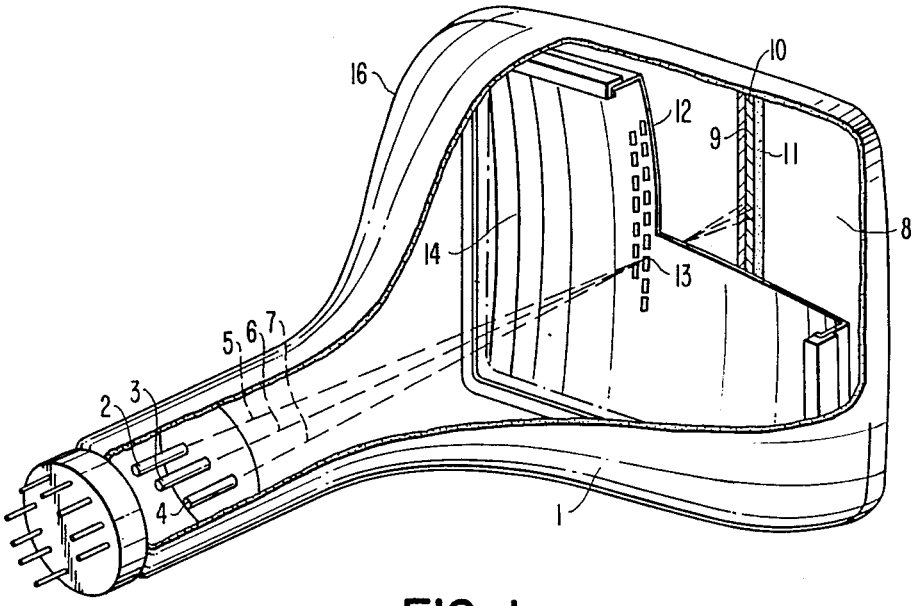
FIG. 1
FIG. 2
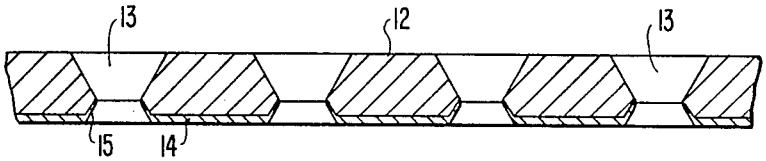

COLOR DISPLAY TUBE

This is a continuation of application Ser. No. 879,830, filed June 26, 1986, now abandoned, which was a continuation of application Ser. No. 636,535, filed Aug. 1, 1984, now abandoned.

The invention relates to a colour display tube comprising in an evacuated envelope means to generate a number of electron beams, a display screen having regions luminescing in different colours and a colour selection electrode which is present near the display screen and has apertures for passing the electron beams and associating each electron beam with luminescent regions of one colour, said colour selection electrode being coated at least on the side remote from the display screen with a layer which comprises a heavy metal. The invention further relates to a method of manufacturing such a colour display tube.

Heavy metal is to be understood to mean hereinafter a metal or an alloy of a metal having an atomic number higher than 70.

A colour display tube of the type mentioned in the opening paragraph is known, for example, from GB-A No. 2 080 612.

This Patent Application describes that a colour display tube having a colour selection electrode which on the side remote from the display screen is coated with a layer of a material comprising a heavy metal, during operation shows considerably less local or overall doming as a result of which the colour purity of the colour display tube would deteriorate.

As a matter of fact a large part of the electrons, on their way to the display screen, are intercepted by the colour selection electrode, sometimes termed shadow mask, and cause local or entire heating of the shadow mask and hence doming. A layer with heavy metal on the side of the colour selection electrode where the electron beams are incident has for its effect that the electron beams are refracted more strongly beyond the apertures and give less rise to heating and doming.

It is also stated already in the above-mentioned literature reference that, depending on the increase of the thickness of the heavy metal-containing layer, the possibility of the occurrence of loose particles in the tube increases. These loose particles may give rise inter alia in the electron gun to high voltage flashovers and on the display screen to black spots in the displayed picture.

One of the objects of the invention is to prevent the occurrence of loose particles in the tube by the action of the electron beams on the heavy metal-containing layer.

Another problem occurring in the colour display tube is the following. The colour selection electrode owes its rigidity for a considerable part to its curvature. Increasing the radius of curvature gives a weakening of the mask. In the present-day developments of the colour display tube there is a tendency to make the screen less convex or even flat. It is then desired to make the colour selection electrode more rigid.

Another object of the invention is to provide a more rigid colour selection electrode.

According to the invention the colour display tube mentioned in the opening paragraph is therefore characterized in that the heavy metal-containing layer on the colour selection electrode is a glass layer having a forming temperature which is at most equal to the temperature of the manufacture of the envelope from the display screen and a cone.

By means of a glass layer it is achieved that parts cannot easily be detached from the layer, as well as that the colour selection electrode as a whole becomes more rigid. By means of a glass layer having the indicated forming temperature it is achieved that no additional thermal treatments for the manufacture of the colour display tube according to the invention are necessary.

The heavy metal is preferably lead. By means of lead, good glass layers can be obtained on a colour selection electrode.

In addition to the heavy metal, at least one glass forming component is present in the glass layer. Boron is preferably present as such.

Particularly good results are obtained when the glass layer is a lead borate glass.

The glass layer preferably consists of 76–80% by weight (52–56 mol. %) of lead oxide, 15–20% by weight (33–45 mol. %) of boron oxide, 0–6% by weight (0–11 mol. %) of zinc oxide and 0.5–2% by weight (1–4 mol. %) of cobalt oxide. A glass layer having such a composition is very suitable as regards coefficient of expansion, melting properties and adhesion to the substrate. Cobalt is included as cobalt monoxide (CoO) to improve the flow properties of the glass.

The glass layer comprising the heavy metal is preferably provided on the colour selection electrode by spraying a lead oxide and boron oxide-containing suspension on the colour selection electrode while on the other side of the colour selection electrode a sub-ambient pressure is maintained.

By means of this method it is achieved that no or hardly any particles deposit on the wall of the apertures in the colour selection electrode so that afterwards no increased reflection at the said walls occurs and the picture quality would deteriorate.

In a subsequent thermal treatment at, for example, approximately 440° C., the glass layer is formed and the glass layer does not flow into the apertures. Preferably, the thermal treatment simply coincides with the stage of manufacture of the colour display tube in which the display screen and the cone are sealed together.

The invention will now be described in greater detail with reference to an example and the accompanying drawing, in which:

FIG. 1 shows diagrammatically a colour display tube according to the invention and FIG. 2 is a sectional view of a part of the colour selection electrode of the tube shown in FIG. 1.

The colour display tube shown diagrammatically in FIG. 1 comprises a glass envelope 1 in which three (diagrammatically shown) electron guns 2, 3 and 4 are present to generate three electron beams 5, 6 and 7.

A display screen 8 is built up from a repeating pattern of phosphor stripes 9, 10 and 11 which luminesce in blue, green and red and are each associated with each of the electron beams 5, 6 and 7 in such manner that each electron beam impinges only on phosphor stripes of one colour.

This is realized in known manner by means of a colour selection electrode (shadow mask) 12 which is placed at a short distance before the display screen 8 and which comprises rows of apertures 13 which pass a part of the electron beams 5, 6 and 7.

Only approximately 20% of the electrons, on their way to the display screen 8, pass through the apertures 13. In order to avoid local or overall heating of the shadow mask, an electron reflective layer 14 is provided which has a heavy metal (see FIG. 2).

In order to avoid crumbling away of the layer 14 and to increase the rigidity of the colour selection electrode 13 as a whole, according to the invention the layer 14 on the colour selection electrode is a glass layer having a forming temperature which is at most equal to the temperature of manufacturing the envelope 1 from the display screen 8 and a cone 16.

The heavy metal advantageously is lead, and boron is present in the glass layer 14 as a glass-forming component. A glass layer 14 consisting of lead borate glass has proved to be very suitable. A lead borate glass 14 comprises, for example, 0.25 mg of Pb and 0.04 mg of B per $cm^2$. The glass layer 14 is provided from an aqueous suspension of a mixture consisting of approximately 16% by weight of boron oxide, 4% by weight of zinc oxide, 79% by weight of lead oxide and 1% by weight of cobalt oxide. The coefficient of expansion readily corresponds to that of the iron colour selection electrode 12.

The said aqueous suspension is sprayed on the colour selection electrode. During spraying, an air flow is maintained in the mask apertures 13 by exhausting the air on the non-sprayed side of the mask 12 by means of an exhauster. By means of these measures it is achieved that at most only little suspension lands on the edge 15 of the apertures 13 so that no undesired electron reflection (taper reflection) takes place on said walls during operation of the tube.

The glass layer is formed by a thermal treatment of the shadow mask at approximately 440° C., the melting properties of the glass used being such that substantially no material lands in the apertures 13.

The coefficient of reflection for electrons of the layer 14 is approximately 45%. This results in a lower temperature of the mask 12 than in the absence of the layer 14 and hence in a smaller overall and local doming of the shadow mask. The thermal treatment simply coincides with the step in which the display screen 8 and the cone 16 of the colour display tube are sealed to the envelope 1.

The invention is not restricted to the example described but may be varied in many manners by those skilled in the art without departing from the scope of this invention.

What is claimed is:

1. A color display tube comprising, in an evacuated envelope:

means for generating a number of electron beams;

a display screen having regions luminescing in different colors when struck by the beams; and a color selection electrode situated between the beam generating means and the display screen, the color selection electrode consisting essentially of a plate having apertures for passing the electron beams and associating each electron beam with luminescent regions of one color, and an electron reflecting layer on the side of the color selection electrode remote from the display screen, characterized in that the layer is a heavy metal containing glass layer consisting essentially of 76 to 80% by weight (52 to 56 mole percent) of lead oxide, 15 to 20% by weight (33 to 45 mole percent) of boron oxide, 0 to 6% by weight (0 to 11 mole percent) of zinc oxide and 0.5 to 2% by weight (1 to 4 mole percent) of cobalt monoxide.

* * * * *